United States Patent [19]

Sato et al.

[11] 4,069,129

[45] Jan. 17, 1978

[54] ELECTROLYTIC CELL

[75] Inventors: Kimihiko Sato; Yasuo Sajima; Toshihiko Kuno, all of Yokohama; Harumi Ohbe, Tokyo, all of Japan

[73] Assignee: Asahi Glass Company, Ltd., Tokyo, Japan

[21] Appl. No.: 677,257

[22] Filed: Apr. 15, 1976

[30] Foreign Application Priority Data

Apr. 15, 1975 Japan ..... 50-44776

[51] Int. Cl.[2] ..... C25B 1/16; C25B 1/26; C25B 9/00

[52] U.S. Cl. ..... 204/258; 204/257; 204/266; 204/275; 204/279

[58] Field of Search ..... 204/252, 253, 255, 256, 204/257, 258, 266, 270, 275, 278, 279

[56] References Cited

U.S. PATENT DOCUMENTS

| | | | |
|---|---|---|---|
| 3,242,065 | 3/1966 | DeNora et al. | 204/256 |
| 3,489,614 | 1/1970 | Tomter | 429/38 |
| 3,778,362 | 12/1973 | Wiechers et al. | 204/254 |
| 3,836,448 | 9/1974 | Bouy et al. | 204/270 |
| 3,864,236 | 2/1975 | Lindstrom | 204/256 X |
| 3,875,040 | 4/1975 | Weltin et al. | 204/256 X |
| 3,948,750 | 4/1976 | Figueras et al. | 204/286 |

*Primary Examiner*—Arthur C. Prescott
*Attorney, Agent, or Firm*—Oblon, Fisher, Spivak, McClelland & Maier

[57] ABSTRACT

A filter-press type electrolytic cell comprising alternatively arranged frames and diaphragms fastened together to form alternating anolyte compartments and catholyte compartments, wherein said frames comprise two oppositely disposed hollow members one of which has an inlet and the other an outlet for the flow of electrolyte solutions said inlet or outlet being on the outside surface thereof and each of said members having holes on the inside surface thereof which surfaces face each other, whereby the appropriate electrolyte is passed from said member having said inlet into the anolyte or catholyte compartment formed in the frame and the electrolyzed product is discharged from said anolyte or catholyte compartment into said member having said outlet.

1 Claim, 8 Drawing Figures

ELECTROLYTIC CELL

BACKGROUND OF THE INVENTION

1. Field of the Invention

The present invention relates to a frame which is used in a filter-press type electrolytic cell formed by alternatively arranging the frames and a diaphragm and fastening them together. More particularly, it relates to a filter-press type diaphragm electrolytic cell used for producing caustic alkali by electrolysis of an aqueous alkali metal salt such as an alkali metal chloride.

2. Description of the Prior Art

In a filter-press type electrolytic cell, frames forming an anode, diaphragms and frames forming a cathode are alternatively arranged and fastened to form anolyte compartments and catholyte compartments which are respectively partitioned by the diaphragms. During electrolysis solutions are fed into and discharged through the frames forming the electrolytic compartments, i.e. the anolyte compartments and catholyte compartments. Frames for conventional electrolytic cells are formed using plates having a central opening and a plurality of surrounding holes. Corresponding holes for the compartments are aligned for communication when the frames are arranged and fastened and grooves are provided for communication of the holes and the electrolytic compartments, as disclosed in U.S. Pat. No. 3,869,375; U.S. Pat. No. 3,017,388 and U.S. Pat. No. 3,933,617. When a solution is fed into an electrolytic compartment or is discharged from it, the solution is passed into the holes communicating through the frames at the bottom of the frames and is fed through the grooves into the electrolytic compartments. The electrolyzed solution or gas is then passed through the grooves into the holes communicating through the frames at the upper portions of the frames and is discharged through the communicating holes. In order to form these grooves and holes on the frames, high processing accuracy and complicated processing operations are required. Such procedures are difficult and expensive. Moreover, it is disadvantages to use block-type frames made of anticorrosive metal from the viewpoints of both expense and weight.

SUMMARY OF THE INVENTION

Accordingly, it is an object of the present invention to provide a filter-press type electrolytic cell which is easily processed and prepared and which can be prepared with low cost and low weight. It is another object of this invention to provide a filter-press type electrolytic cell which comprises a hollow member having therein a passage for liquid or gas. It is still another object of this invention to provide a frame for a filter-press type cell used for producing a caustic alkali by electrolysis of an aqueous alkali metal salt. These and other objects of this invention have been attained by providing a filter-press type electrolytic cell which comprises alternatively arranged frames and diaphragms fastened together to form alternating anolyte compartments and catholyte compartments, wherein said frames comprise hollow members having an inlet or an outlet at the outer surface thereof and holes at the inner surface thereof whereby the appropriate electrolye is passed into the anolyte and catholyte compartments respectively formed in the frame and the electrolyzed product is discharged from said anolyte or catholyte compartment.

BRIEF DESCRIPTION OF THE DRAWINGS

FIGS. 2(b) to (h) are respectively sectional views of other embodiments taken along the line A—A in FIG. 1;

FIGS. 3-1 and 3-2 are respectively sectional views of embodiments taken along the line B—B in FIG. 1;

FIGS. 5-1 and 5-2 are respectively sectional views of embodiments taken along the line C—C in FIG. 4;

DETAILED DESCRIPTION OF THE PREFERRED EMBODIMENTS

Figure 1:
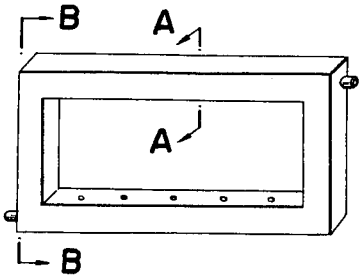
FIG. 1 is a schematic view of a frame comprising a hollow member according to the invention.

Referring to the drawings, the frames of the invention will be illustrated.

It is preferred to fasten the frames and the diaphragm through a gasket to improve the seal between the frame and the diaphragm for the electrolytic cell. The fastening pressure is preferably 1–20 Kg/cm$^2$, especially 2–10 Kg/cm$^2$, by unit area of the frame. It is also preferred to use hollow members having the regular square cross-section shown in FIG. 2*a* as the frame *l* from the viewpoint of easy assembly. It is also possible to use hollow members having other cross-sections such as those shown in FIGS. 2*b* through *h*. The hollow member shown in FIG. 2*b* has a rectangular cross-section. The cross-sections such as those shown in FIGS. 2*c* and *d* are those of a circle and an ellipse, respectively. When such basically round shapes of FIGS. 2*c* and *d* ar used, the seal pressure can be centralized thereby attaining high quality seals when holding the diaphragm to the frames through a gasket. In the embodiment of FIG. 2*e*, a groove is formed on each corresponding side surface. A gasket of O-ring shape can be disposed in the groove. Thus, a diaphragm can be firmly held by merely placing it between the frames and fastening. In the embodiment of FIG. 2*f*, a W shaped projection is formed on each corresponding side surface. As above, a diaphragm can be firmly held by merely placing it between the frames and fastening. In the embodiment of FIG. 2*g*, the hollow member of the frame of FIG. 2*a* is divided into upper and lower compartments to improve the strength of the frame. In this case, one or more holes allowing communication between the lower compartment and the upper compartment are formed. In the embodiment of FIG. 2*h*, skirt parts are formed on the hollow member of FIG. 2*a*.

It is possible to use the hollow members having the cross-sections shown in FIGS. 2*b* through *h* as well as that of FIG. 2*a*, in combination as desired. It is preferred to form a quadrilateral frame shown in FIG. 1 from considerations of frame strength, ease of assembly, and ability to maintain constant concentration in the electrolytic compartment. When the quadrilateral frame is formed with four members, it is necessary to use at least two hollow members. In the preparation of such a rectangular frame, it is preferred to dispose hollow members at least as the upper and lower parts. The side parts can be merely plates or blocks. The size of the frame is preferably in the range of from 3 m to 0.2 m, especially from 2 m to 0.5 m in height, and from 5 m to 0.2 m, especially, from 3 m to 0.5 m in length. The ratio of the height to the length is in the range of from 1/5 to 5/1. The size of the hollow member is preferably from 50 cm to 1 cm, especially from 20 cm to 3 cm in cross-sectional width. The ratio of the width of the hollow member to the height of the frame is in the range of from 1/5 to 1/100.

One or more holes 7 are formed in the lower hollow member 3 through which the solution is fed into the electrolytic compartment. One or more holes 6 are formed in the upper hollow member 2 through which the solution is discharged from the electrolytic compartment. An inlet 8 is formed in the lower hollow member 3 through which the liquid is fed into the hollow member. An outlet 9 is formed on the upper hollow member 2 to enable discharge of the solution from the hollow member. It is also preferred to dispose a gas outlet on the upper hollow member to enable separation of the gas generated by electrolysis. The liquid outlet is disposed at a lower level on the upper hollow member and the gas outlet is disposed on the upper plate of the upper hollow member.

It is sufficient to have only the upper and lower members of the frame be hollow. However, in order to decrease the weight of the frame, it is preferred to use hollow members as the side parts 4 and 5 also. The hollow side parts 4 and 5 can be made independent of the upper and lower hollow members without communication. In such a frame structure, the hollow side parts 4 and 5 can be used to control the temperature, of the electrolytic compartment by passage of a heating or cooling medium through them. However, it is preferred to use the structure of FIG. 3-2 in order to recycle the solution in the electrolytic compartment and to improve the uniformity of concentration of the solution in the electrolytic compartment. In this embodiment, the frame is formed by one continuously communicated hollow member which can be prepared by welding four hollow members together. The solution is fed from the inlet 8' into the hollow zone 3' corresponding to the lower part of the frame and is passed through the holes 7' into the electrolytic compartment. The electrolysis of the solution is conducted and the solution rises in the compartment under gas-lifting action resulting from the gas generated by the electrolysis. It passes through the holes 6' into the hollow zone 2' corresponding to the upper part of the frame. A portion of the solution passed into the upper hollow zone 2' is discharged from the outlet 9' and the remainder passes through the side hollow zone 4', 5' back to the lower hollow zone, from where it is recycled into the electrolytic compartment. In this configuration, because of the recycling flow, the concentration of the solution is uniform and the gas generated by the electrolysis is not retained thereby enabling the use of a low cell voltage.

The material used to make the frame can be selected in accordance with the type of solution and gas with which it will be contacted. Typical materials include titanium, glass fiber reinforced plastic and the like for the anolyte compartment, and iron, nickel, stainless steel and the like for the catholyte compartment. It is also possible to coat the material of the frame with a fluorine type resin such as vinylidene fluoride polymers, tetrafluoroethylene polymers and tetrafluoroethylene-ethylene copolymers. As mentioned above, various frame structures can be formed by assembling the hollow members together. In order to utilize the holes for feeding or discharging the solution and the gas, holes are formed for communication between the central opening and the hollow member on the inner surfaces of the hollow members. The processing required for forming the holes on the surfaces of the hollow members is easily conducted by conventional methods.

Figure 4:
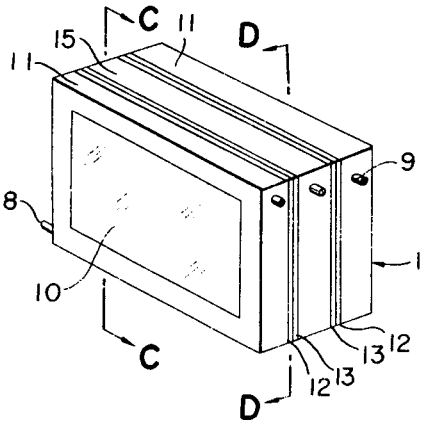
FIG. 4 is a schematic view of a filter-press type electrolytic cell comprising the frames of the invention.

For the electrolytic cell having the frames of this invention, as shown in FIG. 4, the frame for the catholyte compartment 11 having the cathode 10, the gasket 12 and the diaphragm 13 and the frame for the anolyte compartment 15 having the anode 14 are arranged as shown and are fastened to form the electrolytic compartments, i.e., the catholyte compartment 16 and the anolyte compartment 17. The anode is preferably an insoluble electrode such as a platinum group metal, a titanium base coated with a platinum group metal or a titanium base coated with a platinum group metal oxide. The cathode is preferably made of iron, stainless steel or nickel. The electrodes can be net shaped (gas generated by electrolysis does not remain) and plate shaped. The diaphragms are preferably cation permeable membranes which have oxidation and chlorine resistance, such as porous membranes, e.g., asbestos, porous polytetrafluoroethylene; and fluorine-containing polymer type cation-exchange membranes, e.g., copolymers of tetrafluoroethylene and sulfonated perfluorovinyl ether, copolymers of tetrafluoroethylene and carboxylated perfluorovinyl ether and the like. The latter cation exchange membranes are preferably used. For a diaphragm type electrolytic cell using a cation-exchange membrane, it is possible to insert a spacer between the cation-exchange membrane and the electrode so as to prevent direct contact. Suitable spacers include chemically resistant material such as a net of polyolefin or fluorine-containing polymer. The diaphragm, the spacer and the electrode are held with a packing between the frames. When an asbestos diaphragm is used, it can be directly contacted with the cathode. The electrodes can be disposed in the frames by fixing an electrode leading holder on each frame and attaching the electrode thereto. In a three compartment type electrolytic cell having an intermediate compartment between the anolyte and catholyte compartments, the frame for the anolyte compartment having an anode and a diaphragm, the frame for the intermediate compartment having a diaphragm and the frame for the catholyte compartment hainvg a cathode are arranged in series and are fastened to form the electrolytic cell.

The foregoing has described monopolar type electrolytic cells. Bipolar type electrolytic cells can be formed by alternatively arranging the electrodes (one surface of which is the cathode and the other surface the anode), the frames and the diaphragms and fastening them.

Figure 2:
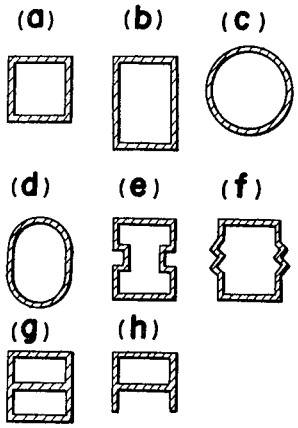
FIG. 2 (a) is a sectional view of one embodiment taken along the line A—A in FIG. 1.
Figures 1, 5:
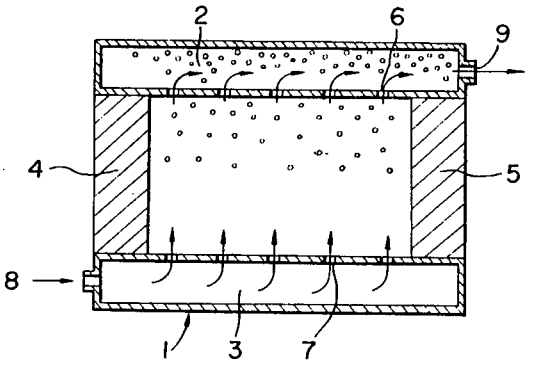
Figures 2, 5:
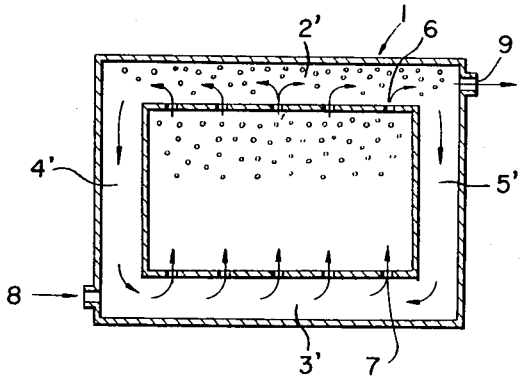
Figure 6:
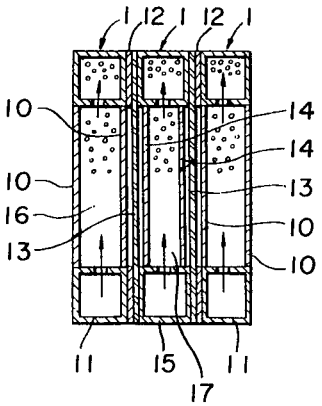
FIG. 6 is a sectional view taken along the line D—D in FIG. 4.

The flow of the solution in the electrolytic cell of FIG. 4 for the electrolysis of an aqueous solution of sodium chloride, will be illustrated with reference to FIGS. 5-2, 5-2 and 6.

Figures 1, 3:
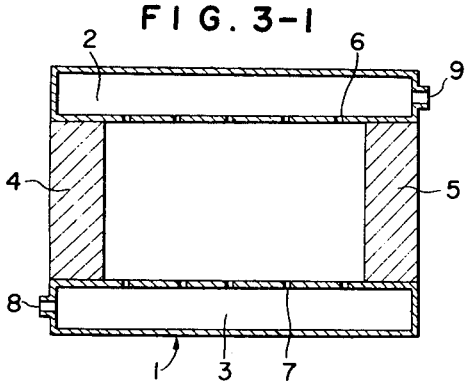
Figures 2, 3:
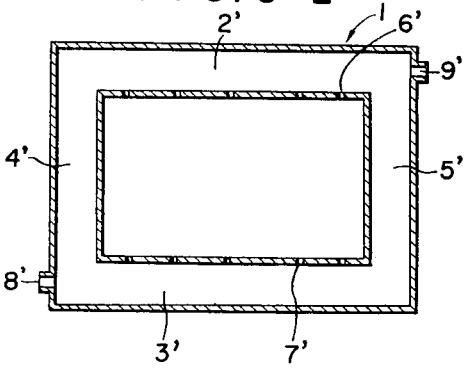

First, the flow of the solution in the electrolytic cell using the frames of FIG. 3-1 will be illustrated with reference to FIGS. 5-1 and 6. FIG. 5-1 is a sectional view taken along the line C—C in FIG. 4 of the electrolytic cell using the frame of FIG. 3-1. FIG. 5-1 shows the structure of the anolyte compartment and the flow of solution in it. The catholyte compartment is formed by a frame of the same structure except for the electrode. This can be clearly understood from FIG. 6 which is a sectional view taken along the line D—D in FIG. 4. The aqueous solution of sodium chloride is fed into the hollow zone 3 corresponding to the lower part of the frame 15 for the anolyte compartment and is passed through the holes 7 into the anolyte compartment 17, wherein electrolysis is conducted to generate $Cl_2$ gas. The electrolyzed solution rises in the compartment and is passed through the holes 6 to the hollow zone 2 corresponding to the upper part of the frame 15 for the anolyte compartment and is discharged. At the same time, in the frame 11 for the catholyte compartment water or a dilute aqueous solution of sodium hydroxide is fed from the inlet 8 to the hollow zone 3 corresponding to the lower part of the frame 11 and is passed through the holes 7 into the catholyte compartment 16, wherein electrolysis is conducted to produce an aqueous solution of sodium hydroxide and to generate hydrogen gas. The electrolyzed solution rises in the compartment and is passed through the holes 6 into the hollow zone 2 corresponding to the upper part of frame 11 and is discharged from the outlet 9.

The flow of the solution in the electrolytic cell of FIG. 4 using the frames of FIG. 3-2 will be illustrated with reference to FIG. 5-2. FIG. 5-2 shows the structure of the solution in the anolyte compartment.

The catholyte compartment has the same structure except for the nature of the electrode. For example, an aqueous solution of sodium chloride is fed through the inlet 8 into the hollow zone 3' corresponding to the lower part of the frame 15 for the anolyte compartment 17 and is passed through the holes 7 into the anolyte compartment 17 wherein electrolysis is conducted to generate $Cl_2$ gas. The electrolyzed solution rises in the compartment under gas-lifting action, and is passed through the holes 6 into the hollow zone 2' corresponding to the upper part of the frame 15 for the anolyte compartment 17. A part of the solution passes through the side hollow zones corresponding to the side parts 4' and 5' of the frame and is recycled into the anolyte compartment 17. At the same time, water or a dilute aqueous solution of sodium hydroxide is fed from the inlet 8 into the hollow zone 3' corresponding to the lower part of the frame 11 for the catholyte compartment 16 and is passed through the holes 7 into the catholyte compartment 16 wherein electrolysis is conducted to produce an aqueous solution of sodium hydroxide and to generate hydrogen gas. The electrolyzed solution rsies in the compartment under gas-lifting action and is passed through the holes 6 to the hollow zone 2' corresponding to the upper part of the frame 11 for the catholyte compartment 16. A part of the solution passes through the side hollow zones 4' and 5' corresponding to the side parts of the frame and is recycled to the catholyte compartment. The feed flow with the hollow member is remarkably slow and direct flow from the inlet 8' to the outlet 9' is usually prevented by appropriate selection of the size of the holes on the hollow members. Direct flow can be prevented by disposing appropriate members inside the hollow member. The recycle of the electrolyzed solution can also be effected by using an outer connecting pipe as well as the inner communicating hollow members.

One example of the operation using the electrolytic cell will be illustrated. Four hollow members made of titanium (having a cross-section square 70 × 70 mm; thickness 3 mm) were assembled to from a rectangular frame (height of 1 mm; length of 2 m) as shown in FIG. 3-2. An inlet and outlet for liquid and gas were formed in the frame and an anode was disposed in the frame to form a frame for the anolyte compartment. Four hollow members made of stainless steel were assembled in the same structural form, and a cathode disposed in the frame to form a frame for a catholyte compartment. The inner surface of the upper hollow member had 17 holes (20 mm in diameter). The inner surface of the lower hollow member had 32 holes (9 mm in diameter). The frame for the anolyte compartment, a gasket made of natural rubber, a fluorine type resin cation-exchange membrane, and the frame for the catholyte compartment were serially arranged and fastened to form an electrolytic cell as shown in FIG. 4. An aqueous solution of sodium chloride (315 g/liter) was fed at a flow rate of 0.1 $m^3$/hr to the anolyte compartment, wherein chlorine gas was generated at a rate of about 10 $m^2$/hr. The chlorine gas was discharged together with the diluted solution (electrolyzed: 210 g/l of NaCl aq.sol.) from the anolyte compartment. The diluted solution was recycled through the vertical hollow members at a flow rate of about 3 $m^3$/hr. On the other hand, water was fed at a flow rate of 0.014 $m^3$/hr to the catholyte compartment, wherein hydrogen gas was generated at a rate of about 5.5 $m^3$/hr. The hydrogen gas was discharged together with the resulting aqueous solution of sodium hydroxide (500 g/l of NaOH aq.sol.) (a flow rate of 0.022 $m^3$/hr). The aqueous solution of sodium hdyroxide was recycled through the vertical hollow members at a flow rate of about 2 $m^3$/hr. The flows were effected by gas-lifting action. The electrolysis was continuously conducted for one month under a current density of 20 A/$dm^2$ and a voltage of 4.0 volts.

What is claimed as new and intended to be covered by letters patent is:

1. A filter press type electrolytic cell comprising:

a frame for a first catholyte compartment comprising:
- a first lower hollow member,
- a first upper hollow member,
- the first lower and upper hollow members having the same cross sectional shape,
- a first left cathode and a first right cathode joining together the first lower hollow member and the first upper hollow member to form a first catholyte compartment therebetween,
- the first lower hollow member having apertures in its surface disposed between the first left and the first right cathodes,
- the first upper hollow member having apertures in its surface disposed between the first left and the first right cathodes, a frame for a second anolyte compartment comprising:
- a second lower hollow member,
- a second upper hollow member,
- the second lower and upper hollow members having the same cross sectional shape,
- a second left anode and a second right anode joining together the second lower hollow member and the second upper hollow member to form a second anolyte compartment therebetween,
- the second lower hollow member having apertures in its surface disposed between the second left and the second right anodes,
- the second upper hollow member having apertures in its surface disposed between the second left and the second right anodes, a frame for a third catholyte compartment comprising:
- a third lower hollow member,
- a third upper hollow member, the third lower and upper hollow members having the same cross sectional shape, a third left cathode and a third right cathode joining together the third lower hollow member and the third upper hollow member to form a third catholyte compartment therebetween, the third lower hollow member having apertures in its surface disposed between the third left and the third right cathodes, the third upper hollow member having apertures in its surface disposed between the third left and the third right cathodes, the first lower and upper hollow members, the second lower and upper hollow members and the third lower and upper hollow members having the same cross sectional shape, the second lower hollow member being aligned with and disposed between the first lower hollow member and the third lower hollow member, the second upper hollow member being aligned with and disposed between the first upper hollow member and the third upper hollow member, a first diaphragm disposed between the first right cathode and the second left anode but contacting neither the first right cathode nor the second left anode, the first diaphragm contacting the second lower and upper hollow members and gaskets which contact the first lower and upper hollow members, a second diaphragm disposed between the second right anode and the third left cathode but contacting neither the second right anode nor the third left cathode, the second diaphragm contacting the second lower and upper hollow members and gaskets which contact the third lower and upper hollow members.

* * * * *